United States Patent [19]

Morgan

[11] 4,294,183

[45] Oct. 13, 1981

[54] CUTTER CONFIGURATION FOR EFFICIENT ICE DISAGGREGATION AND CLEARING

[75] Inventor: George W. Morgan, San Jose, Calif.

[73] Assignee: Suncor Inc., Toronto, Canada

[21] Appl. No.: 139,960

[22] Filed: Apr. 14, 1980

[51] Int. Cl.[3] ..... B63B 35/12

[52] U.S. Cl. ..... 114/42; 299/79; 175/18; 172/122

[58] Field of Search ..... 114/42, 41, 40; 172/111, 122, 554; 175/18; 299/24, 25, 26, 27, 28, 79, 89; 405/211, 61

[56] References Cited

U.S. PATENT DOCUMENTS

| | | | |
|---|---|---|---|
| 1,415,663 | 5/1922 | Lilleberg | 172/554 X |
| 1,472,641 | 10/1923 | Etrich | 299/89 X |
| 2,197,549 | 4/1940 | Hargrave | 299/25 |
| 2,857,835 | 10/1958 | Fitzgerald | 172/554 |
| 3,791,328 | 2/1974 | Schirtzinger | 114/42 |
| 4,005,666 | 2/1977 | Schirtzinger | 114/42 |
| 4,102,288 | 7/1978 | Berry | 114/42 X |

*Primary Examiner*—Trygve M. Blix
*Assistant Examiner*—John C. Paul
*Attorney, Agent, or Firm*—J. Edward Hess; Donald R. Johnson; James H. Phillips

[57] ABSTRACT

In order to improve the efficiency and reliability of the cutter units employed in large scale ice disaggregation systems, a cutter configuration is employed characterized by an outwardly extending arm which sweeps rearwardly from the direction of travel to provide clearance for ice chunks and then sharpwardly forwardly to terminate in an ice-engaging portion. The ice-engaging portion includes a relatively long and narrow central "pick" portion for breaking very cold ice, chisel-like cutting edges directed to each side of the base of the "pick" portion to fracture cold ice as well as warm ice, and an inverted skate portion which cleaves the ice and promotes passage of the ice chunks around the tooth structure to facilitate clearing.

4 Claims, 5 Drawing Figures

CUTTER CONFIGURATION FOR EFFICIENT ICE DISAGGREGATION AND CLEARING

BACKGROUND OF THE INVENTION

This invention relates to the ice disaggregation arts and, more particularly, to novel aspects of ice-breaking teeth supported upon one or more large, vertically oriented drums adapted to engage and disaggregate ice.

In the petroleum exploration, drilling, and production industry, it is often necessary to move and station men and equipment in relatively hostile environmental regions. In recent years, the emphasis on offshore oil production in the far north has necessitated the development of new techniques for encountering formations of encroaching ice floes and the movements thereof which threaten the stability and/or position of equipment situated therearound.

In the Arctic, offshore Labrador, and the like, large regions of the ocean are often covered by thick layers of ice. Currently, there is considerable activity in these and other frozen areas directed toward the discovery and development of sources of petroleum and other natural resources. The search for and production of these resources require operational platforms for housing equipment and personnel. These platforms are typically passively transported to their operational sites and maintained in a relatively fixed position with respect to the underwater floor by anchoring thereto and/or by the utilization of dynamic positioning techniques. It may be noted, however, that some such platforms are self-propelled. In the normal course of operation, drill-strings, pipes, and the like are extended from the platform into the earth's sub-surface for accessing and recovering natural resources such as petroleum. It is thus important to maintain the platform within a predetermined envelope in order to prevent breaking or, whenever possible, the necessity for withdrawing the extended apparatus from the ocean floor.

Platforms located in both shallow and deep waters are exposed to ice floes which sometimes float freely on the water and/or unitary ice formations which flow insidiously. The ice may be so massive that a platform is susceptible to damage or destruction as a result of forces imparted thereagainst by the moving ice. The Arctic Ocean, for example, is characterized by air temperatures ranging from −70° F. to 70° F., ice sheets and thicknesses between 6 and 10 feet, and pressure ridges of 10 to 100 feet. In such conditions, ice typically exhibits a compressive strength of 1,000 to 3,000 psi and tensile strength of 300 to 1,000 psi. The problems of providing the requisite magnitude of force and power necessary for engagement with and disaggregation of such an environmental threat may be seen to be formidible.

Drilling and operations platforms for use in ice covered areas may take several different forms. One such platform includes a monopod, semi-submersible design utilizing a single rotating cutter completely encircling the intermediate hull section proximate the waterline for ice floe engagement and disaggregation. The cutter is disposed between upper superstructure comprising an operations platform and a submerged hull providing flotation and storage. In this manner, only a relatively narrow profile emerges through encroaching ice layers while platform surface area is maximized and buoyancy size parameters are met, respectively, above and below the ice.

A similar operations platform, which is disclosed in detail in U.S. Pat. No. 4,102,288 entitled "Operations Vessel for Ice Covered Seas", comprises a monopod, semi-submersible drilling vessel constructed with an ice-breaking wedge and ice disaggregation apparatus, the wedge and ice disaggregation apparatus comprising an intermediate hull section. The nautical wedge facilitates transit operation in both open and ice laden waters and also achieves ice-breaking within its capability while in the operating mode. The ice disaggregation portion of the intermediate hull section includes a plurality of drums rotatably mounted in generally upstanding relationship relative to the submersible hull. The drums include an outer surface adapted for breaking, cutting and/or chipping ice engaged thereby. Preferably, a pair of drums is mounted for counterrotation such that reaction torque is cancelled and other benefits are obtained.

A floating platform which employs somewhat similar ice engaging and disaggregating means is disclosed in U.S. Pat. No. 4,070,052 entitled "Method and Apparatus for Disaggregating Particulate Matter". The platform disclosed therein includes ice disaggregating apparatus supported by booms which include telescoping struts which support the ice disaggregation apparatus for movement around the entire platform. More particularly, an array of rotatable cutting drums is configured with the axis of rotation of one drum forming an oblique angle with the axis of rotation of a second drum. Rotation of the drums produces improved mass removal effectiveness by first cutting and chipping serrations to form ridges therebetween which subsequently shatter when struck at an oblique angle by the cutters of a second drum. In a variant configuration, an array of three, independently rotatable drums mounted in a triangular configuratiion is emloyed. Each drum is comprised of a generally elliptical cross-sectional shape wherein teeth protruding outwardly of adjacent drums do not overlap.

Yet another ice disaggregating system of interest is disclosed in U.S. Pat. No. 4,069,783 entitled "Method and Apparatus for Disaggregating Particulate Matter". As disclosed and discussed in detail therein, the ice disaggregation system comprises the employment of a vertically oriented, rotatable drum disposed ahead of, and adapted to sweep across the path of, a ship from which the drum is supported. The teeth disposed on the rotatable drum have aligned pairs of sledge teeth of progressively increasing lengths extending therefrom. Adjacent each array of aligned pairs of sledging teeth, centrally positioned therebetween and to the rotative rear thereof, there is provided a slugging tooth adapted for striking engagement with the particulate matter engaged and laterally isolated therebetween by the sledging teeth.

It is important to appreciate that the teeth carrying, ice engaging drums discussed in the foregoing are all vey large, particularly those associated with the semi-submersible operations vessels. It has been found that, when such drums become so large, the configuration of the ice engaging teeth is of great importance if acceptable efficiency is to be obtained in driving the ice disengaging drums and if acceptable tooth life and maintenance methods are to be obtained. That is, the relatively straightforward tooth designs characteristic of conventional drum ice disaggregating means (which have been in use for many years) cannot simply be scaled up to obtain the desired quality and economy of operation, fabrication, and maintenance necessary in such very large installations as herein contemplated.

Attention has been given, in the recent prior art, to the special requirements of the teeth and their mounting structure employed on the giant ice engaging drums of semi-submersible operations vessels. In particular, reference may be taken to U.S. Pat. Application Ser. No. 940,245, entitled "Means for Increasing the Efficiency of and Ice Disaggregation System", U.S. Pat. Application Ser. No. 940,245 entitled "Multiple Tine Ice Disaggregation System", and U.S. Pat. Application Ser. No. 940,247 entitled "Ice Disaggregation System", each by George W. Morgan, and each filed Sept. 7, 1978. These references disclose various specially configured teeth and also special mounting means comprising very large brackets which extend outwardly from the drum periphery and each of which carry several individually removeable teeth.

In the operation of such large semi-submersible operations vessels employing correspondingly large ice engaging drum structures, clearing of the broken ice chunks creates an unprecedented problem. As the ice is disaggregated from the main ice sheet, it passes into the annulus area where, due to the disaggregation process, it expands in volume. It is believed that this increased volume is approximately one-third greater than the original volume of the uncut ice.

Within the annulus area (i.e., proximate the counterrotating drums) the disaggregated ice particles are moved through the discharge side areas at a speed approximately that of the rotational speed of the cutters. However, once the ice chunks pass through the restricted discharge side areas, they enter the full width cleared by the cutters. In this region, there is a rapid drop in velocity resulting in the ice packing behind the particles previously cleared. When the ice is relatively thin, discharged particles can move beneath the ice sheet provided the volume cut remains low. As the ice becomes thicker and/or with an increase in the speed of the cutters and the vessel, the disaggregated ice can rapidly become packed preventing any further flow of the discharged material. The quantity discharged can be enormous. For a cutting width of fifty-three feet, fifty-five foot thick ice, and a forward cutting velocity of 1.83 feet/second, approximately 5,300 cubic feet of ice is disaggregated per second. Thus, it will be apparent that, in order for the vessel to maintain position or traverse the ice when disaggregating large volumes of ice, the discharged ice particles in the ice in the discharged area must be kept moving and directed in such a way as to aid in clearance. The tooth configuration contemplated by the present invention achieves favorable ice clearing, as well as ice cutting characteristics.

SUMMARY OF THE INVENTION

It is therefore a broad object of this invention to provide improved ice disaggregation means.

It is another object of this invention to provide improved ice engaging teeth especially suited for employing with large revolving drums which carry such teeth peripherally disposed for engagement with large ice masses.

It is a more particular object of this invention to provide such teeth by which ice fracturing is obtained with less expenditure of force needed to propel the teeth and in which clearing of the broken ice chunks is facilitated by the teeth shape and by the preferential fracture regions promoted thereby.

Briefly, these and other objects of the invention are accomplished by employing teeth which extend radially outwardly from the drum periphery, have a rearwardly swept portion leading to a forwardly sweeping arcuate "gooseneck" portiion which terminates in the ice cutting tooth portion. The ice cutting portion includes a pointed central tip, an inverted skate portion, and wing-like projections having sloped upper surfaces and chisel-like leading edges. This configuration promotes major ice breakage in tension and further breakage into chunks which tend to pass above and below the tooth, thus insuring clearing efficiency as well as ice breaking efficiency.

DESCRIPTION OF THE DRAWING

The subject matter of the invention is particularly pointed out and distinctly claimed in the concluding portion of the specification. The invention, however, both as to organization and method of operation may best be understood by reference to the following description taken in conjunction with the accompanying drawing of which:

DESCRIPTION OF THE PREFERRED EMBODIMENT

Figure 1:
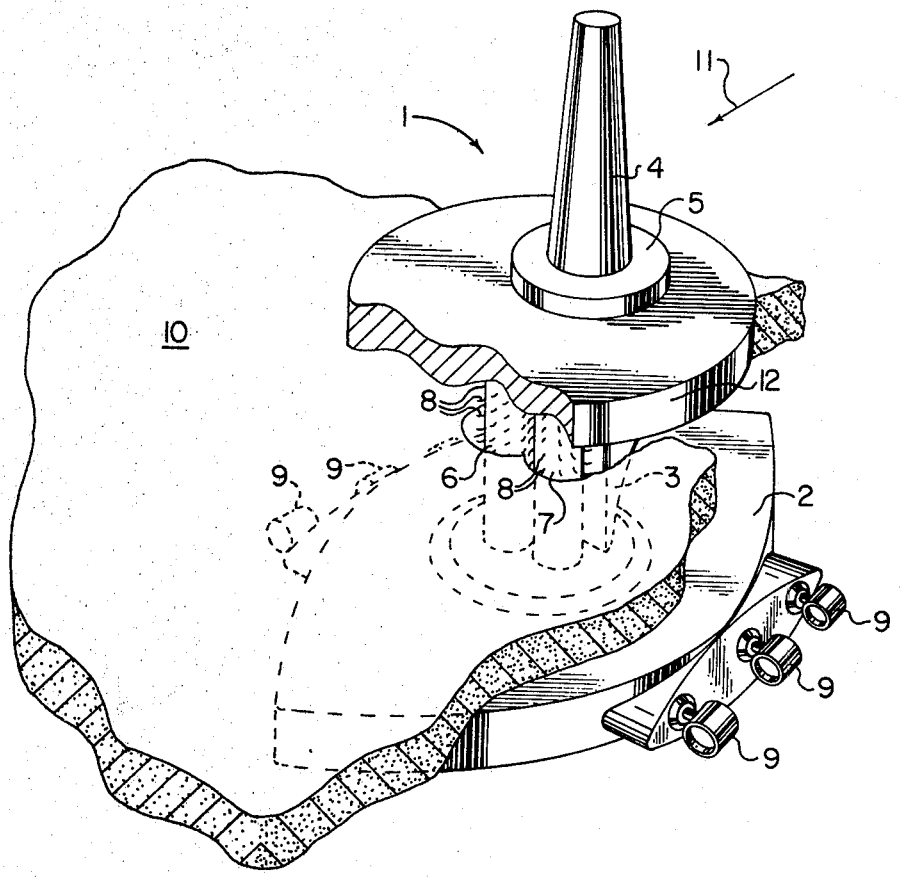
FIG. 1 illustrates a typical environment in which the present invention finds favorable use, which environment comprises a semi-submersible operations platform fitted with very large ice disaggregating means.

Referring now to FIG. 1, an exemplary environment for the present invention is shown and comprises an operations vessel 1 which is a semi-submersible, monopod type platform for drilling, production, processing, and/or storage and the like. The vessel 1 is provided with a flotation hull section 2 adapted for submerged support and sustenance of the remaining vessel and also providing storage therefor. A plurality of propulsion units 9 are constructed around the flotation hull 2 for achieving a transit mode of operation, dynamic positioning while in a stationary mode, and the capacity to engage ice floes in the positioning and operation thereof.

The vessel 1 is constructed with an intermediate hull section extending upwardly from the flotation hull 2 and includes a nautical wedge portion 3 and an ice disaggregation portion comprising counterrotating drums 6 and 7. Atop the intermediate hull, a deck structure 12 is constructed for housing above-water operations. A shrouded derrick 4 upstands from the deck structure 12, the shroud being provided for safety and environmental protection and for decreasing wind drag forces. An operations area 5 is similarly provided in a shrouded configuration beneath and adjacent the derrick 4 for protecting platform personnel during platform operations. In the shrouded configuration shown, the topside profile of the vessel 1 is substantially comprised of circular shapes which eliminate wind direction sensitivity.

In FIG. 1, the vessel 1 is shown advancing in a transit mode through an ice sheet 10. It will be observed that the counterrotating drum cutters 6, 7, disaggregate the ice sheet in order to permit relative movement (indicated by the arrow 11) between the ice sheet 10 and the platform 1 in a direction generally governed by the orientation of the thrusters 9. More detailed description of the operations vessel 1 will be found in the aforementioned U.S. Pat. No. 4,102,288. As previously indicated, the present invention is directed to improvements in the structure of the teeth 8 associated with the ice disaggregating drums 6, 7 or similar ice disaggregating drums.

It is important, in order to obtain a full understanding of the present invention, that some appreciation of the size of the relevant structure be obtained. Thus, it will be understood that the axial dimension of the drums 6, 7 is on the order of 50 to 100 feet or even more.

Figure 2:
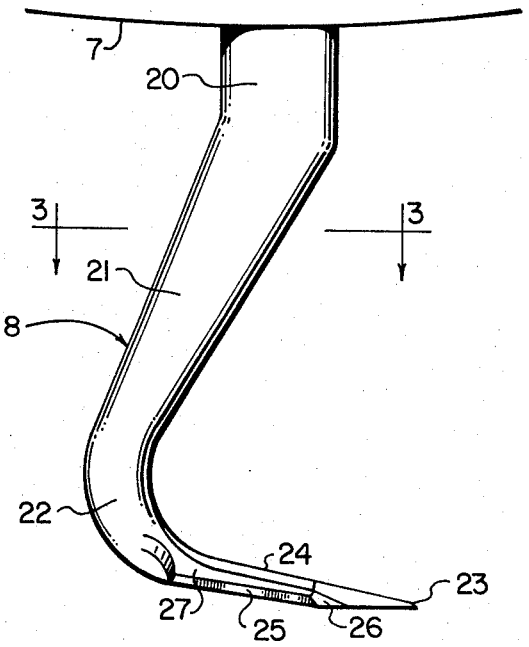
FIG. 2 is a side view of a presently preferred embodiment of an ice disaggregating tooth according to the present invention.
Figure 4:
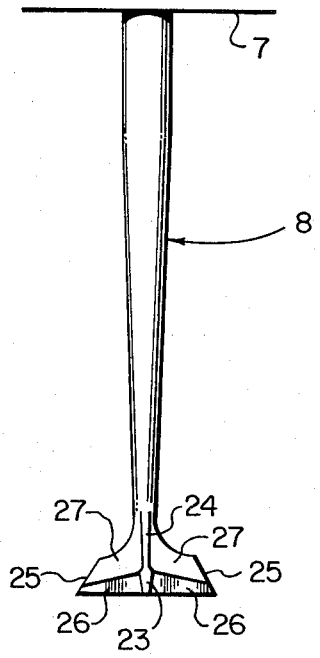
FIG. 4 is a front view of the tooth depicted in FIG. 2.
Figure 3:
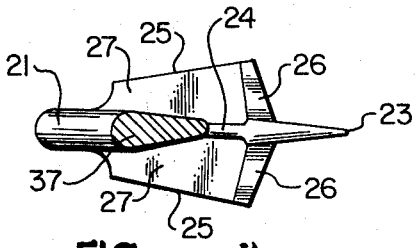
FIG. 3 is a cross-sectional view of the tooth depicted in FIG. 2 taken along the lines 3—3 thereof.

Referring now to FIGS. 2, 3, and 4 which are, respectively, side, top, and head-on views (looking axially proximate the periphery of drum 7) of a single cutter tooth 8, it will be observed that a tooth base portion 20 extends generally radially outwardly from the surface of the drum 7. A rearwardly angled arm portion 21 of the tooth 8 extends outwardly from the base portion 20 to an arcuate "gooseneck" curvature portion 22 which sweeps forwardly to the cutting portion of the tooth which includes a pointed central tip 23 (which is especially effective in cutting very cold ice), an inverted skate portion 24, wing-like projections 25 extending outwardly on each side of the inverted skate portion 24, and chisel-like leading edges 26 to the wing-like projections. It will be noted that the wing-like projections 25 also have upper surfaces 27 which slope upwardly toward the rear and upwardly toward the centerline of the tooth 8.

Figure 5:
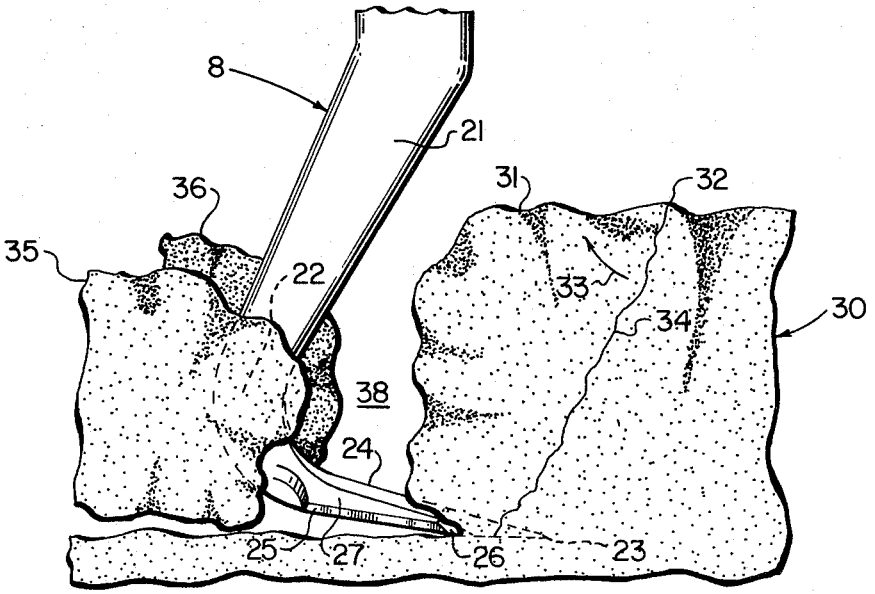
FIG. 5 illustrates the tooth of FIGS. 2, 3, and 4 as it is employed to disaggregate ice while promoting preferential clearance thereof.

The manner in which the various elements of the tooth 8 cooperate to effect efficient ice breaking and clearing may best be understood by reference to FIG. 5. As the sharp pointed leading edge or "pick" 23 drives into the ice 30, the chisel-like leading edges 26 of the wing-like projections 25 engage a chunk 31 of the ice sheet 30 and apply a bending moment around the region 32 as indicated generally by the arrow 33. As a result, the ice is subjected to tension stress which produces a fracture 34 just prior to the chunk 31 being broken loose.

A pair of just previously broken chunks 35 and 36, which are shown passing, respectively, above and below the rearwardly projecting arm portion 21 and the gooseneck portion 22 of the tooth 8, were cleaved in the bending mode by the action of the inverted skate portion 24 into the two separate chunks which were guided outwardly on either side of the tooth by the sloped upper surfaces 27 of the wing-like projections 25 and by the cross-sectional shape (best shown at 37 in FIG. 3) of the side surfaces of the tooth structure. It will be seen that the rearward sweep of the tooth portion 21 provides a region 38 in which the disaggregated and cleaved chunks have room moving away from the tooth sufficiently to prevent jamming in the region 38 and thus minimize ice impact on the tooth structure behind the cutting edge, thereby mitigating secondary breakage and increased drag. Thus, not only ice breaking efficiency, but also clearing efficiency, is obtained by the tooth configuration depicted.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A semi-submersible operations vessel for ice covered seas including a subsurface flotation hull, an above-surface deck structure, and an upstanding intermediate hull extending between said flotation hull and said deck structure, said intermediate hull including at least one vertically oriented, rotatable ice disaggregating drum having a plurality of ice-engaging teeth distributed about the peripheral surface thereof, each of said teeth comprising:

(A) a base portion extending outwardly from said peripheral surface;

(B) an intermediate portion effecting a continuation of said tooth structure from said base portion, said intermediate portion being angled rearwardly with respect to the direction of drum rotation during ice disaggregating operations;

(C) a forwardly sweeping arcuate portion effecting a continuation of said tooth structure from said intermediate portion; and (D) an ice engaging portion effecting a continuation of said tooth structure from said arcuate portion, said ice engaging portion including:

(i) an inverted skate element oriented along the centerline of said ice engaging portion, said inverted skate element having an edge generally facing the peripheral surface of said drum; and (ii) first and second wing-like projections extending, respectively, outwardly on first and second sides of said inverted skate element and oriented generally parallel to the axis of said drum, said wing-like projections terminating at their forward ends in ice engaging chisel-like leading edges.

2. The operations vessel of claim 1 in which said tooth ice engaging portion further includes a centrally disposed pick element generally aligned with said inverted skate element and extending forwardly beyond said chisel-like leading edges of said wing-like projections.

3. The operations vessel of claim 2 in which surfaces of said wing-like projections facing the peripheral surface of said drum are tapered from relatively thin outer edges to thicker inner regions proximate said inverted skate element.

4. An ice engaging tooth structure adapted to be affixed to and carried by a rotatable ice disaggregating drum, said tooth structure including:

(A) a base portion extending outwardly from the peripheral surface of said drum;

(B) an intermediate portion effecting a continuation of said tooth structure from said base portion, said intermediate portion being angled rearwardly with respect to the direction of drum rotation during ice disaggregating operations;

(C) a forwardly sweeping arcuate portion effecting a continuation of said tooth structure from said intermediate portion; and (D) an ice engaging portion effecting a continuation of said tooth structure from said arcuate portion, said ice engaging portion comprising:

(i) an inverted skate element oriented along the centerline of said ice engaging portion, said inverted skate element having an edge generally facing the peripheral surface of said drum;

(ii) wing-like projections extending outwardly, respectively, on first and second sides of said inverted skate element and oriented generally parallel to the axis of said drum, said wing-like projections terminating at their forward ends in ice engaging chisel-like leading edges; and (iii) a centrally disposed pick element generally aligned with said inverted skate element and extending forwardly beyond said chisel-like leading edges of said wing-like projections.

* * * * *